US009099290B2

(12) United States Patent
Jung et al.

(10) Patent No.: US 9,099,290 B2
(45) Date of Patent: Aug. 4, 2015

(54) COLLISION CELL MULTIPOLE

(71) Applicant: Thermo Fisher Scientific (Bremen) GmbH, Bremen (DE)

(72) Inventors: Gerhard Jung, Delmenhorst (DE); Lothar Rottmann, Ganderkesee (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 14/367,845

(22) PCT Filed: Dec. 21, 2012

(86) PCT No.: PCT/EP2012/076812
§ 371 (c)(1),
(2) Date: Jun. 20, 2014

(87) PCT Pub. No.: WO2013/093077
PCT Pub. Date: Jun. 27, 2013

(65) Prior Publication Data

US 2015/0102215 A1 Apr. 16, 2015

(30) Foreign Application Priority Data

Dec. 21, 2011 (GB) ..... 112073.8

(51) Int. Cl.

| | |
|---|---|
| ***H01J 49/42*** | (2006.01) |
| ***H01J 49/26*** | (2006.01) |
| ***H01J 49/06*** | (2006.01) |
| ***H01J 49/00*** | (2006.01) |

(52) U.S. Cl.
CPC ..... *H01J 49/426* (2013.01); *H01J 49/005* (2013.01); *H01J 49/0027* (2013.01)

(58) Field of Classification Search
CPC ..... H01J 49/062; H01J 49/065; H01J 49/005; H01J 49/36; H01J 49/063; H01J 49/26; H01J 49/004
USPC ..... 250/281, 282, 288, 292, 287, 396 R
See application file for complete search history.

(56) References Cited

U.S. PATENT DOCUMENTS

| | | | | |
|---|---|---|---|---|
| 6,111,250 | A | 8/2000 | Thomson et al. | |
| 6,417,511 | B1 | 7/2002 | Russ, IV et al. | |
| 7,071,467 | B2 * | 7/2006 | Bateman et al. | 250/292 |
| 7,145,133 | B2 * | 12/2006 | Thomson | 250/281 |
| 2004/0011956 | A1 | 1/2004 | Londry et al. | |

(Continued)

FOREIGN PATENT DOCUMENTS

| | | | |
|---|---|---|---|
| GB | 2476191 | A | 6/2011 |
| WO | WO2009037598 | A2 | 3/2009 |

*Primary Examiner* — Nikita Wells
(74) *Attorney, Agent, or Firm* — Charles B. Katz

(57) ABSTRACT

Mass spectrometer collision/reaction cell multipole and method. The multipole may have first and second portions and an intermediate portion therebetween, the first and second portions operating at first and second q values lower than a third q value at the intermediate portion. A low-mass cut-off of the multipole may be controlled by varying a q value from a first to at least a second value. The multipole may have multipole electrodes disposed about a central axis and having a respective first portion, second portion, and intermediate portion therebetween which is radially closer to the central axis. This offers relatively high acceptance and ion transmission, while providing low-mass cut-off for removing undesired/interfering ions and helping reduce background count.

12 Claims, 13 Drawing Sheets

(56) References Cited

U.S. PATENT DOCUMENTS

| | | | | |
|---|---|---|---|---|
| 2004/0031916 | A1 | 2/2004 | Bateman et al. | |
| 2008/0265154 | A1 | 10/2008 | Cousins et al. | |
| 2010/0102217 | A1 | 4/2010 | Okumura et al. | |
| 2010/0301210 | A1 | 12/2010 | Bertsch et al. | |
| 2011/0240851 | A1 | 10/2011 | Okumura et al. | |
| 2014/0353493 | A1 * | 12/2014 | Mordehai et al. | 250/287 |

* cited by examiner

| mass | Straight 4.5 mm | 1 step 4.5-3 mm | 2 steps 4.5-3.75-3mm | Curved 4.5-3-4,5 mm |
|---|---|---|---|---|
| 4.5 | 2.6 | 0.4 | 0.9 | 0.6 |
| 24.5 | 3.2 | < 2 | 1.1 | 0.1 |
| 60.4 | 6.6 | < 2 | 0.5 | 1.7 |
| 110.6 | 3.7 | 0.3 | 1 | 0.4 |
| 143.5 | 6 | 0.6 | 0.3 | 0.4 |
| 220.7 | 6.5 | 0.2 | 0.2 | 0.6 |

| Voltages | STD | CCT | KED |
|---|---|---|---|
| Exit Plate | -200V | -40V | -40V |
| CCT Bias | -2V | -6V | -21V |
| Entry Plate | -80V | -80V | -80V |

COLLISION CELL MULTIPOLE

FIELD OF THE INVENTION

The present invention relates to a collision cell multipole in a mass spectrometer and an associated method. The term "collision cell" is used herein to mean a collision and/or reaction cell. The invention may be used with various mass spectrometry techniques, including LC-MS, GC-MS, fragmentation (MS/MS) in LC-$MS^2$ or GC-$MS^2$ environments, or as a reaction cell for any types of reaction, including collisional activation, fragmentation by ion-ion, ion-electron, ion-photon or ion-neutral interaction, etc. The operation of the collision cell is independent of the nature of the ion source, which could be API (atmospheric pressure ionization), such as ICP, MALDI or ESI as well as ionization in vacuum, including EI, MALDI, ICP, MIP, FAB, SIMS, but the following discussion will focus on embodiments using inductively coupled plasma mass spectrometry (ICP-MS).

BACKGROUND OF THE INVENTION

The general principles of ICP-MS are well known. ICP-MS instruments provide robust and highly sensitive elemental analysis of samples, down to the part per trillion (PPT) range and beyond. Typically, the sample is a liquid solution or suspension and is supplied by a nebuliser in the form of an aerosol in a carrier gas; generally argon or sometimes helium. The nebulised sample passes into a plasma torch, which typically comprises a number of concentric tubes forming respective channels and is surrounded towards the downstream end by an helical induction coil. A plasma gas, typically argon, flows in the outer channel and an electric discharge is applied to it, to ionise some of the plasma gas. A radiofrequency electric current is supplied to the torch coil and the resulting alternating magnetic field causes the free electrons to be accelerated to bring about further ionisation of the plasma gas. This process continues until a steady plasma state is achieved, at temperatures typically between 5,000 K and 10,000 K. The carrier gas and nebulised sample flow through the central torch channel and pass into the central region of the plasma, where the temperature is high enough to cause atomisation and then ionisation of the sample.

The sample ions in the plasma next need to be formed into an ion beam, for ion separation and detection by the mass spectrometer, which may be provided by a quadrupole mass analyser, a magnetic and/or electric sector analyser, a time-of-flight analyser, or an ion trap analyser, among others. This typically involves a number of stages of pressure reduction, extraction of the ions from the plasma and ion beam formation, and may include a collision/reaction cell stage for removing potentially interfering ions.

A problem encountered with the above analysers, especially relatively low mass resolution devices such as quadrupoles, is the presence in the mass spectrum of unwanted artefact ions which interfere with the detection of some analyte ions. The identity and proportion of artefact ions depends upon the chemical composition of both the plasma support gas and the original sample. The interfering ions are typically argon-based ions (such as $Ar^+$, $Ar_2^+$, $ArO^+$), but may include others, such as ionised metal oxides, metal hydroxides or, depending on the matrix of the solution, molecules including matrix ions, e.g. $ArCl^+$ or $ClO^+$ in an HCl (hydrochloric acid) solution. The collision/reaction cell is used to promote ion collisions/reactions with a gas which is introduced into the cell, whereby the unwanted molecular ions (and $Ar^+$) are preferentially neutralised and pumped away along with other neutral gas components, or dissociated into ions of lower mass-to-charge ratios (m/z) and rejected in a downstream m/z discriminating stage.

A collision cell is a substantially gas-tight enclosure through which ions are transmitted and it is positioned between the ion source and the main mass analyser. A collision/reaction target gas, such as hydrogen or helium, among others, is supplied into the cell. The cell typically comprises a multipole (a quadrupole, hexapole, or octopole, for example), which is usually operated in the radio frequency (RF)-only mode. Generally speaking, the RF-only field does not separate masses like an analysing quadrupole, but has the effect of focusing and guiding the ions along the multipole axis. The ions collide and react with molecules of the collision/reaction gas and, by various ion-molecule collision and reaction mechanisms, interfering ions are preferentially converted to non-interfering neutral species, or to other ionic species which do not interfere with the analyte ions.

An additional technique for discriminating against artefact or reaction product ions which pass out of the collision cell is by kinetic energy discrimination. The principle of this technique is that larger, polyatomic interfering ions will have a larger cross section for collisions in the collision cell, so generally lose more kinetic energy than analyte ions. By running a downstream device, such as the analysing quadrupole, or merely an electrically biased aperture, at a more positive potential than that of the collision cell, a kinetic energy barrier is provided. The more energetic analyte ions can overcome this barrier, while the collision cell product ions are impeded.

Some examples of collision cells using multipole rods are as follows. U.S. Pat. No. 5,767,512 relates to the selective neutralisation of carrier gas ions with a charge transfer gas. WO-A1-00/16375 relates to the use of a collision cell to selectively remove unwanted artefact ions by causing them to interact with a reagent gas. U.S. Pat. No. 6,140,638 relates to the operation of the collision cell with a pass band. U.S. Pat. No. 5,847,386, U.S. Pat. No. 6,111,250, and US-A1-2010/0301210 relate to the use of a DC axial field gradient on the rods in the collision cell. U.S. Pat. No. 5,939,718 and U.S. Pat. No. 6,417,511 relate to various assemblies of more than one multipole or a multipole and a ring stack. U.S. Pat. No. 5,514,868 and U.S. Pat. No. 6,627,912 relate to kinetic energy filtering methods.

In view of the above, it would be desirable to provide an alternative and/or improved collision cell multipole which can efficiently transmit analyte ions while reducing or preventing the passage of interfering species towards a downstream mass analyser. The invention aims to address the above and other objectives by providing an improved or alternative multipole and associated method.

SUMMARY OF THE INVENTION

According to one aspect of the invention, there is provided a collision cell multipole, the multipole comprising a plurality of multipole electrodes disposed about a central axis, at least some of the multipole electrodes having a respective first portion, second portion, and intermediate portion therebetween, wherein the intermediate portion is radially closer to the central axis than its respective first portion and second portion.

In this way, the arrangement can provide a high acceptance at the entrance end, operation at a relatively high frequency to pass lower m/z value ions, and a reduced diameter region for ejecting lower m/z ions and for removing background interfering species. However, in addition to these advantages, providing an increased diameter region downstream of the narrowed region provides for improved transmission of ions downstream, out of the collision cell.

Embodiments of the invention can provide an RF-only multipole provided with a changing q value along its length. Preferably, the q value changes from a first, relatively low value at the entrance end of the multipole to at least a second value which is relatively higher than the first. In this way, relatively high acceptance and ion transmission may be achieved, while also providing low-mass cut-off for removing undesired, potentially interfering ions and helping to the reduce background count. In a preferred embodiment, there is provided a further change in q value downstream, whereby the q value changes to a third, relatively low value at the exit end of the multipole, preferably the same as the first q value.

According to another aspect of the invention, there is provided a method of operating a multipole in a collision cell, the multipole comprising a first portion, a second portion and an intermediate portion therebetween, the method comprising the step of operating the first and second portions at respective first and second q values lower than a third q value at the intermediate portion.

According to another aspect of the invention, there is provided a method of operating a multipole in a collision cell, comprising controlling a low-mass cut-off of the multipole by varying a q value in the multipole from a first value to at least a second value.

Advantageously, the collision cell is provided as a substantially gas-tight enclosure.

Other preferred features and advantages of the invention are set out in the description and in the dependent claims which are appended hereto.

BRIEF DESCRIPTION OF THE DRAWINGS

The invention may be put into practice in a number of ways and some embodiments will now be described by way of non-limiting example only, with reference to the following figures, in which.

DESCRIPTION OF PREFERRED EMBODIMENTS

Quadrupoles, used as mass filters or ion guides, are commonplace in mass spectrometry applications today. A general overview of this device is given in "The Quadrupole Mass Filter: Basic Operating Concepts"; Miller and Denton; pp. 617-622, vol. 63, no. 7, July 1986. As is known, the filtering action of a quadrupole mass analyser is provided by the application of a time-varying, radio-frequency (RF) potential and a static DC potential to the rods of the quadrupole. The same RF potential is applied to opposing pairs of rods in the quadrupole, with the RF potential on one pair being 180° out of phase with the RF potential applied to the other pair. A positive DC potential is applied to one of the pairs and a negative DC potential is applied to the other of the pairs. The resulting field within the quadrupole permits only selected ions to pass through it with a stable trajectory, while radially displacing ions with an unstable trajectory, filtering them out of the ion beam due to collisions with the electrodes.

The calculation of full solutions to the behaviour of ions in a quadrupole is complex, but it is possible to simplify matters by defining two parameters, a and q, and plotting regions in a-q space where solutions to the equations of motion of the ions are stable. The parameters, a and q, are defined such that $$a = \frac{4eU}{\omega^2 r_0^2 m} \text{ and } q = \frac{2eV}{\omega^2 r_0^2 m}$$

where e is the charge on the particle, U is the magnitude of the applied DC potential, V is the magnitude of the applied RF potential, ω is the angular frequency (2 nf) of the applied RF potential, $r_0$ is the quadrupole field radius (the distance from the central axis of the quadrupole to each electrode of the quadrupole) and m is the mass of the ion.

Figure 1:
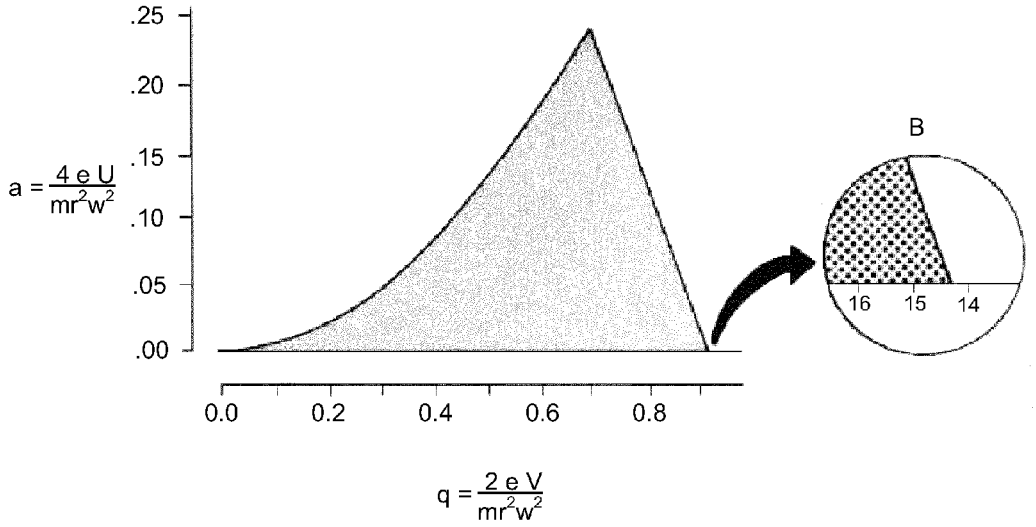
FIG. 1 shows a stability diagram in a-q space.

FIG. 1 shows an example of a stability diagram in a-q space, as shown in the above paper. When the quadrupole is operated with the parameters a and q related linearly (i.e., so that the ratio a/q is constant, so that the ratio U/V is also held constant) the gradient of the line represents a mass scan line. If the mass scan line is arranged to pass over or close to the tip of the stability graph, the particular mass-to-charge ratio passing through the tip will have a stable trajectory, while other ions will not. By increasing V and U simultaneously, while keeping their ratio constant, the magnitude of the mass represented on the mass scan line increases, so that a mass spectrum may be obtained. If the ratio U/V is lowered, the mass scan line passes through a broader region of the stability graph, so that the mass resolution of the quadrupole would be reduced.

When such a quadrupole is operated in a collision cell, the quadrupole is typically operated with RF-only potentials (no DC potentials), so that it generally acts as an ion guide for the ions passing through the collision cell. In terms of the stability diagram shown in FIG. 1, this is equivalent to setting the parameter a to 0 (since U=0). As shown in FIG. 1, the mass scan line is represented by a line in a-q space which has a gradient of 0 and crosses the a axis at a=0. Thus, the quadrupole operates with a relatively broad stability region, so that a large portion of the mass scan line falls within the region of stable trajectories. As can be seen from inset B in FIG. 1, however, the quadrupole operating in RF-only mode is a high-pass mass filter, rejecting ions of m/z below a certain value. In the example shown in FIG. 1, m/z values above 15 are passed, while m/z values of 14 or lower are unstable and are filtered out. Of course, various parameters and operating conditions will affect the range of the high-pass filter (the mass range of an ICP-MS is typically in the range of around 4 u to around 280 u (unified atomic mass unit, sometimes referred to as Da). As shown in FIG. 1, at values of q above approximately 0.91, ions become unstable in the RF-only quadrupole.

While operating a mass spectrometer with a collision cell with an RF-only quadrupole operating so as to satisfactorily transmit ions of medium to high mass (tens to low hundreds of u), the inventors found that low-mass elements such as Li were not transmitted through the collision cell when operated in kinetic energy discrimination (KED) mode. In order to try to address this, for a given mass, the inventors sought to reduce the value of q. This was achieved by operating the quadrupole at a higher frequency, of 3 MHz, instead of 1 MHz. From the stability diagram of FIG. 1, it can be seen that, with an increased frequency, lower-mass ions are able to have a q value which lies within the stability region of the quadrupole.

In this specification, standard (STD) mode is operation of the collision cell with no collision/reaction gas therein; i.e., in a full transmission mode. Collision cell technology (CCT) mode is operation of the collision cell with a collision/target gas therein, but no kinetic energy discrimination. Kinetic energy discrimination (KED) mode is operation of the collision cell with a collision/target gas therein and with the application of a kinetic energy barrier downstream of the collision cell.

Figure 2:
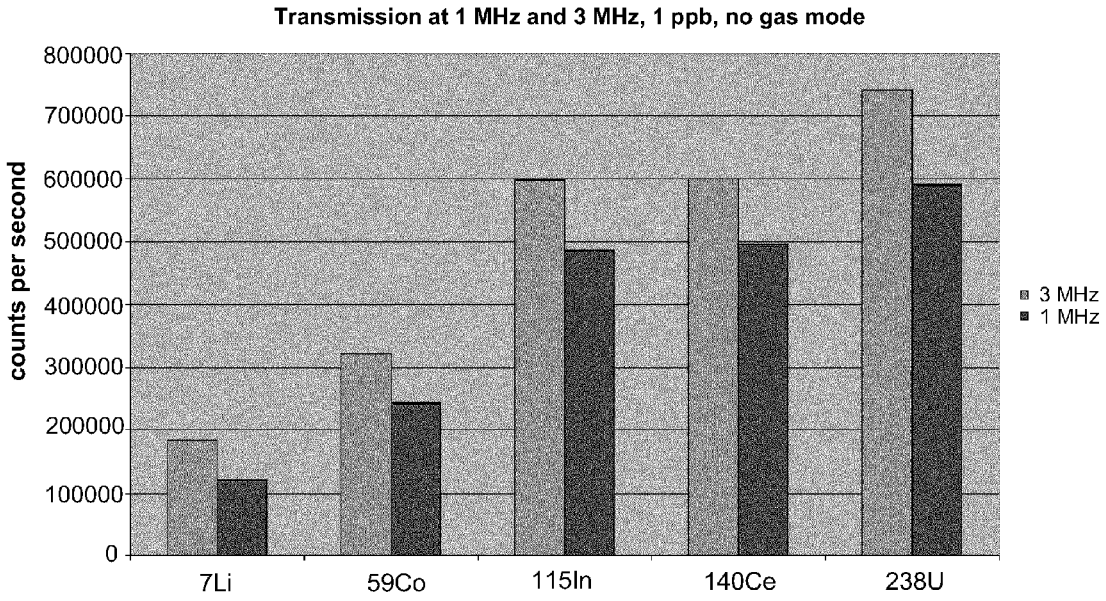
FIG. 2 shows a plot of ion transmission in standard mode.
Figure 3:
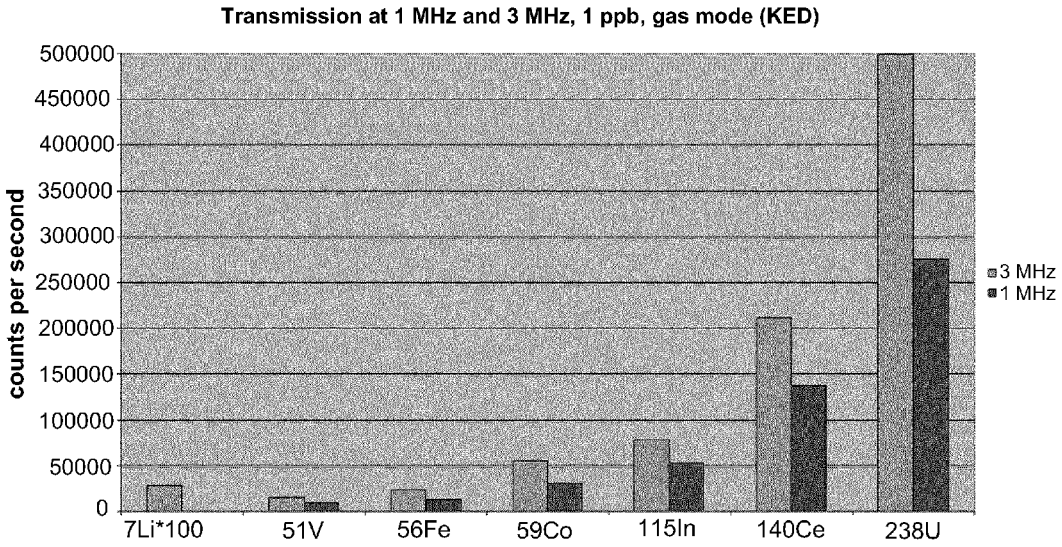
FIG. 3 shows a plot of ion transmission in collision mode.

FIGS. 2 and 3 show comparisons of measurements obtained with the quadrupole in the collision cell operating at 1 MHz and at 3 MHz, with FIG. 2 representing operation of the collision cell without a target (collision or reaction) gas and FIG. 3 representing operation with such a target gas and operation in kinetic energy discrimination mode. As can be seen, in both cases, there was greater transmission of all analytes at 3 MHz, compared to 1 MHz. For example, for lithium, FIG. 2 shows a count rate of around 120 kcps at 1 MHz and around 185 kcps at 3 MHz; while FIG. 3 shows a zero count rate at 1 MHz and a count rate of around 300 cps at 3 MHz. It can be seen, then, that increasing the frequency allows for an increase in transmission of lower-mass ions, such as Li.

However, despite increasing the transmission of low-mass analyte ions, it was also found that background ions formed in, or at the exit of, the collision cell undesirably passed out of the cell and downstream. For example, with higher frequency and the same RF amplitude, the q value is lower for higher masses, so that—at different settings, optimized e.g. for the analysis of heavy metals—40Ar and other high-intensity (predominant) masses are no longer rejected by the quadrupole. It will be understood that, on the one hand, it is desirable to be able to pass low-mass ions at all, when they are the target of analysis (this is achieved by adjusting the voltage (i.e., the RF amplitude, V) accordingly). On the other hand, it is desirable to be able to reject relatively low-mass interferences (especially argon), when the analysis target has a higher mass, ranging through all heavy metals, e.g. from iron (m/z=56) or V, Cr, Mn, to uranium (m/z 238) or even higher actinoids. Typically, downstream of the collision cell, the transmitted ions are transported through an ion optical device which acts to separate ions from neutral gas which emanates from the collision cell, such as, for example, by being accelerated into a double deflector lens, before they enter the mass analyser. In this region, disadvantageously some of the ions may become neutralised and make their way as fast neutrals through the mass analyser (typically a quadrupole mass filter) into the detector. This leads to a continuous background count of around 5 to 10 cps in standard mode (i.e., non-CCT mode, with no target gas in the collision cell). The background count is proportional to the total ion current transmitted through the collision cell and also proportional to the gas pressure in the collision cell. Thus, with increased transmission of undesired ions such as $Ar^+$, $O^+$ and $N^+$ there is a general increase in the production of fast neutrals and therefore an increase in the background count. When operating at 1 MHz, in the original configuration, this increasing background count was not present, because the quadrupole was operated at a q value which did not generally pass such mass values (it is believed that the change in q caused a greater transmission of 40Ar and other interfering species, giving rise to this effect).

A similar finding was made when the quadrupole of a conventional collision cell (with $r_0$=4.5 mm) was operated at a still higher frequency of 4.5 MHz; namely, increased ion transmission, but increased background count. Thus, in an attempt to address this, a further test was conducted with quadrupole rods operated with $r_0$=2 mm and V=4.5 MHz. However, in this case it was found that the transmission of ions was reduced to 70% compared to the conventional cell. The transmission of ions at small masses was comparable, but a strongly negative bias voltage on the collision cell of less than −10 V was found to be necessary. Furthermore, the sensitivity in KED mode was lower than with the standard cell and matrix recovery (i.e., the effect on sensitivity of an analyte ion, e.g. Co, in different concentrations of a matrix solution, e.g. a nickel solution of 100 ppm or 1000 ppm compared to a blank solution) is also not better than with the standard collision cell. It is understood that these effects were caused by space charge in the collision cell.

Since operating the quadrupole at a higher frequency but with a lower inner quadrupole radius was not successful, the inventors developed the idea of a stepped quadrupole, where the inner quadrupole radius at the entrance end is greater than an inner quadrupole radius towards the downstream end. In this way, the inventors believed that the quadrupole could have a high acceptance at the entrance of the collision cell (i.e., so that ions could pass into the quadrupole, with reduced or substantially no effect from fringing fields at the entrance end of the quadrupole), to improve ion transmission into and through the quadrupole. At the same time, to account for the increased frequency of operation of the quadrupole, the inventors believed that the smaller radius between the rods at the downstream end would help to remove low-mass ions formed inside the collision cell (i.e., m/z values significantly lower than the m/z of current interest; usually, this will mean the removal of Ar or compounds containing Ar, N or O). The higher radius region at the entrance of the quadrupole has a lower low-mass cut off (i.e., passes ions of a lower m/z value), but this would also mean that low-mass ions formed inside the collision cell would be transmitted, so the lower radius region at the downstream end of the quadrupole has a higher low-mass cut off (i.e., passes ions with higher m/z values). This arrangement is generally understood to provide a broader transition region between the high-pass mass filter characteristic and the low-mass stop-band characteristic of the quadrupole and to provide suppression or reduction of unwanted ions formed in the collision cell.

Figure 4:
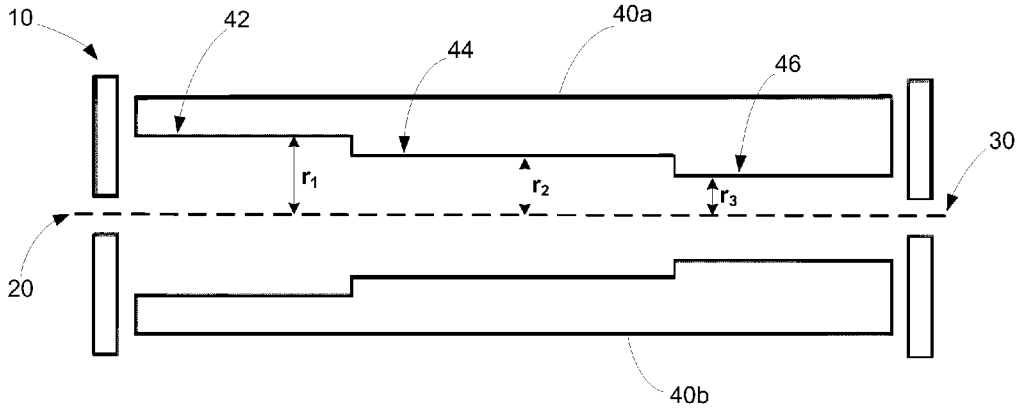
FIG. 4 shows a stepped multipole according to one embodiment.

FIG. 4 shows schematically a collision cell 10 with an entrance aperture 20 and an exit aperture 30 and comprising a quadrupole 40. The figure shows a cross-section of the cell, so that only two, opposing rods, 40*a*, 40*b* are shown. Each rod 40*a*, 40*b* is stepped in the downstream direction and, in this case, has two steps 44, 46. A first, upstream section 42 of the quadrupole rod 40*a* is configured at a first radial distance $r_1$ from the central axis about which the quadrupole is arranged. A second section 44, downstream of the first section 42, is stepped radially towards the central axis and is configured at a radial distance $r_2$ from the axis lower than $r_1$. A third section 46 of the quadrupole rod, downstream of the second section 44, is provided with a second step towards the central axis and is configured at a radial distance $r_3$ from the axis lower than both $r_1$ and $r_2$. In the arrangement shown in FIG. 4, $r_1$=4.5 mm, $r_2$=3.75 mm, and $r_3$=3.0 mm. The overall axial length of each rod was 133 mm.

However, the presence of steps in the quadrupole leads to the creation of pseudo-potential barriers along the central axis, resulting in axial forces which can retard or even reflect ions. As a result, low-mass ions are not transmitted through the stepped quadrupole as well as in the quadrupole with no steps.

Figure 5:
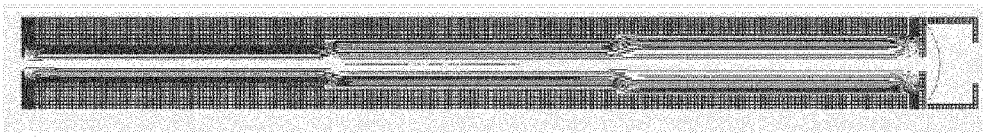
FIG. 5 shows a simulation of static potentials.
Figure 6:
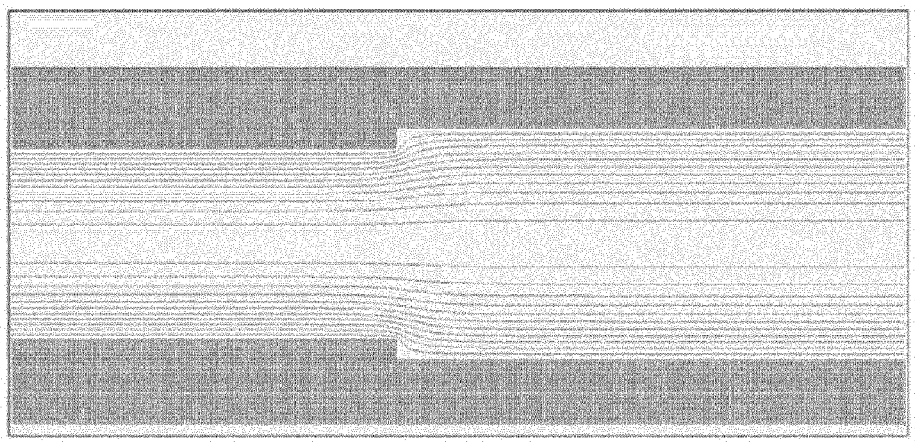
FIG. 6 shows a close-up of a portion of FIG. 5.

A simulation of the static electric potential field in the quadrupole of FIG. 4 is shown in FIG. 5, and a close-up of one of the stepped regions is shown in FIG. 6. As can be seen, the steps in the quadrupole create a repulsive field which can reflect or slow down the ions, especially close to the rods.

Figure 7:
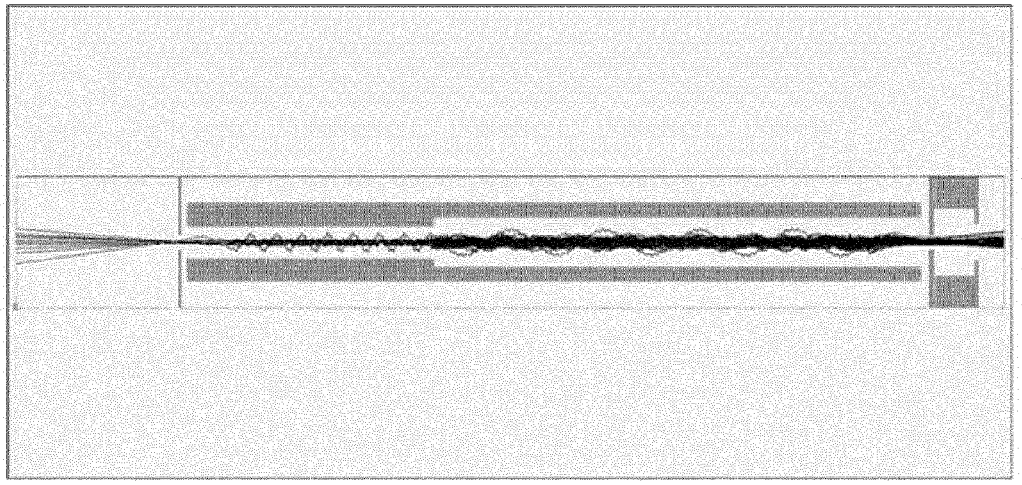
FIG. 7 shows simulated ion trajectories in a stepped multipole in standard mode.
Figure 8:
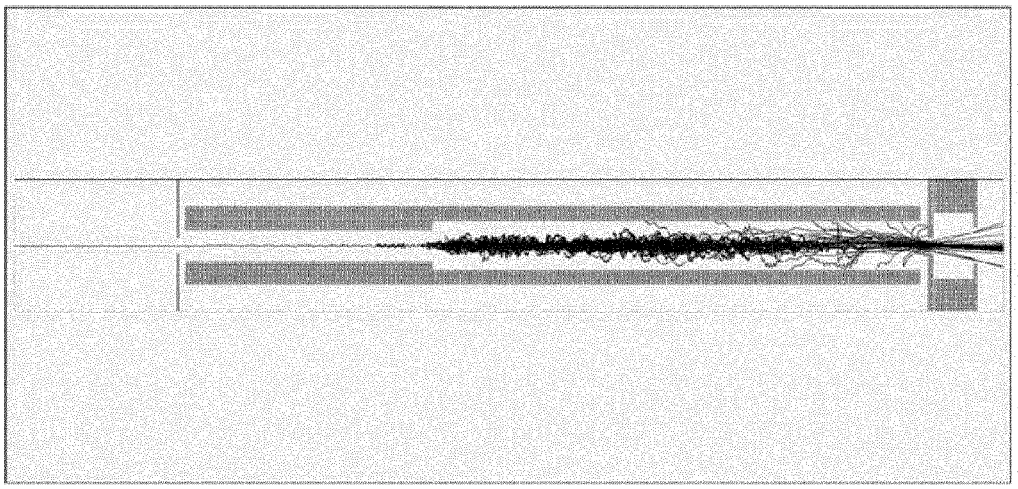
FIG. 8 shows simulated ion trajectories in a stepped multipole in collision mode.
Figure 9:
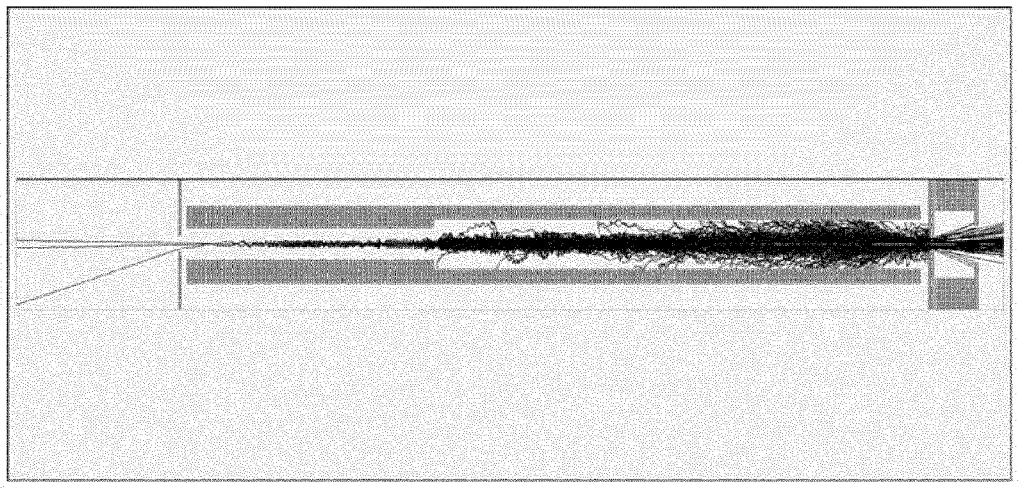
FIG. 9 shows simulated ion trajectories in a stepped multipole in collision mode.

To investigate this further, ion trajectory simulations were performed with a quadrupole having a single step at the downstream end, operated with $r_1$=4.5 mm, $r_2$=3.0 mm, V=3 MHz, and q=0.47 for the upstream part of the multipole. FIG. 7 shows the simulation when the collision cell is operated in standard mode (i.e., with no target gas). As can be seen, higher m/z ions are transmitted, but low-energy ions (typically, low m/z value ions) are reflected at the step. FIG. 8 shows the ion trajectory simulation when the collision cell is operated in CCT (collision cell technology; target gas in the cell) mode. In this case, the collision cell is supplied with helium at a pressure of 3 Pa, and a bias voltage of −21 V is applied to the collision cell. Here, it can be seen that lithium is nearly completely rejected in the collision cell, so effectively cannot pass out of the collision cell. FIG. 9 shows an ion trajectory simulation, also in CCT mode, but with a pressure reduced to 2 Pa. As can be seen, again, ions are heavily reflected at the abrupt radius change of the quadrupole, so most ions do not pass through the collision cell.

Figure 10:
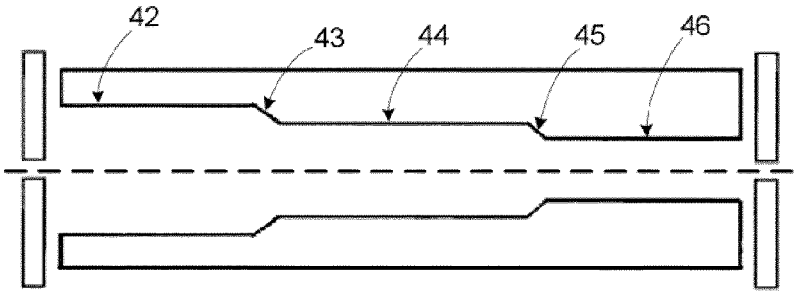
FIG. 10 shows a sloped stepped multipole according to one embodiment.

One way considered by the inventors to address the effect of the pseudo-potential barrier resulting from the stepped quadrupole rods is to "soften" or smooth the abruptness of the change in radius, by providing a sloped transition region between the steps, as shown schematically in FIG. 10. Here, a quadrupole rod with two stepped portions 44, 46 is provided with sloped transition regions 43, 45 into the steps.

Figure 11:
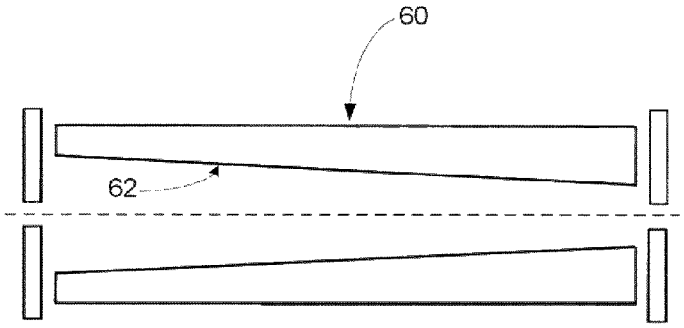
FIG. 11 shows a sloped multipole according to one embodiment.

Taking this principle further, FIG. 11 shows a quadrupole having quadrupole rods 60 with an axially inclined inner rod surface 62, having a largest radius at its entrance end and a lowest radius at its exit end. With the surface 62 having a substantially constant gradient in this way, pseudo-potential barrier reflections should be minimised or at least reduced.

Figure 12:
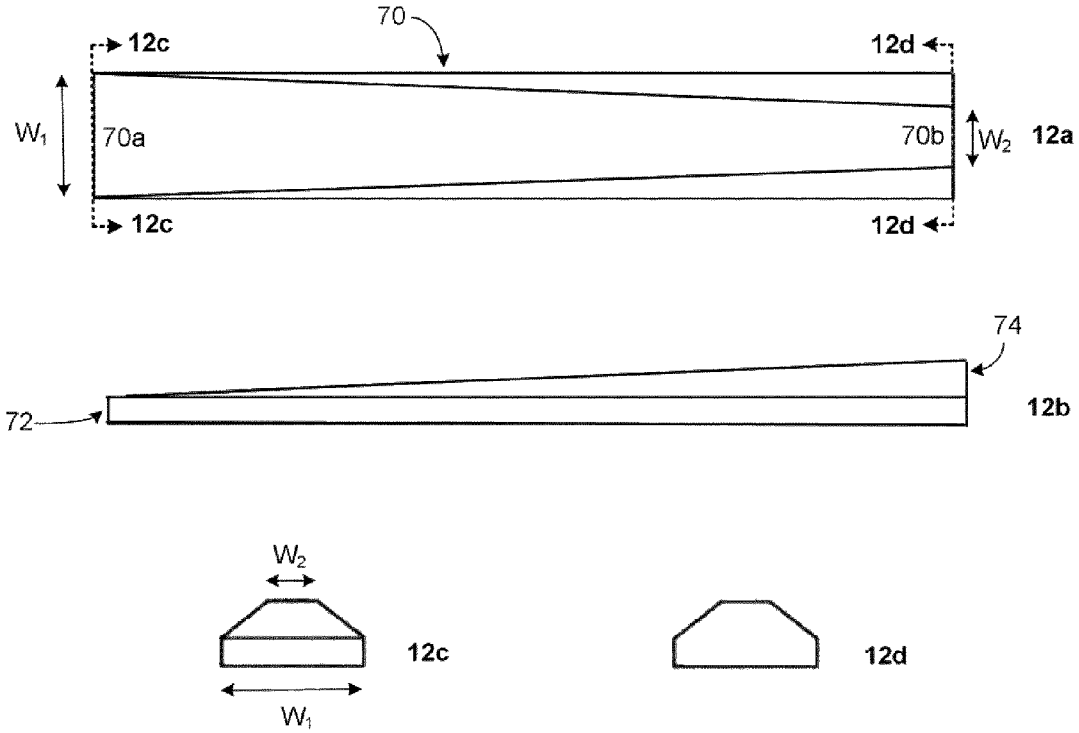
FIGS. 12*a-d* show a radially narrowed electrode according to one embodiment.

With the thickness of each rod increasing in the radial direction, at the region or regions of reduced diameter from the central axis, in some embodiments the rods may be narrowed in the radial direction towards the central axis, so that there is sufficient room around the axis for each of the multipoles. FIG. 12 shows such a tapered or narrowed electrode, suitable for use in the arrangement shown in FIG. 11. FIG. 12*a* shows a plan view of a quadrupole rod 70, as would be seen from the central axis (i.e., the part of the rod 70 facing the central axis). FIG. 12*b* shows a side view of the rod 70, with the rectangular cuboidal portion 72 being arranged radially furthest from the central axis in use and a wedge portion 74 being radially closest to the central axis. FIG. 12*c* shows an elevation view from the upstream end 70*a* of the rod 70 and FIG. 12*d* shows an elevation view from the downstream end 70*b* of the rod. As can be seen, the radially inner portion 74 narrows from a first width W1 to a second width W2 (less than W1) towards the downstream end, where the rod is radially closer to the central axis. This allows the four rods of the quadrupole to be arranged symmetrically about the central axis with sufficient room.

One alternative to providing narrowed portions of the rods is to space the rods further apart where the inscribed radius within the quadrupole is greater (i.e., at the upstream, entrance end). However, this configuration has a number of disadvantages, including the possibility of the ions being affected by the electric field from the surrounding material of the collision cell.

Figure 13:
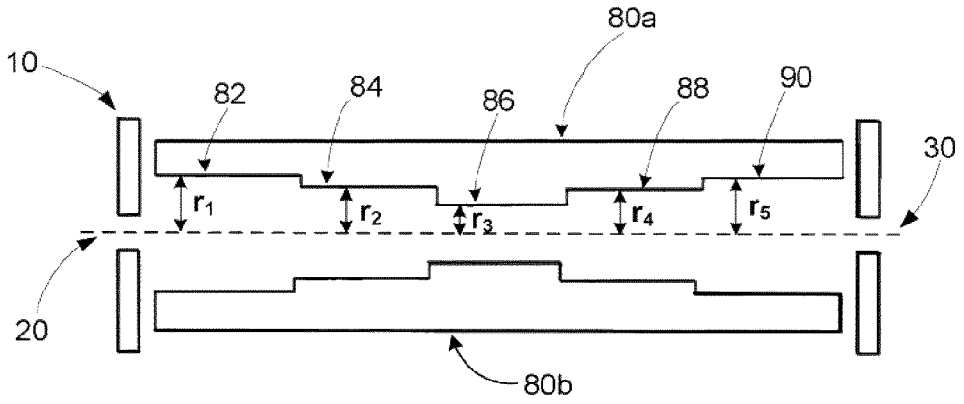
FIG. 13 shows a centrally stepped multipole according to one embodiment.
Figure 18:
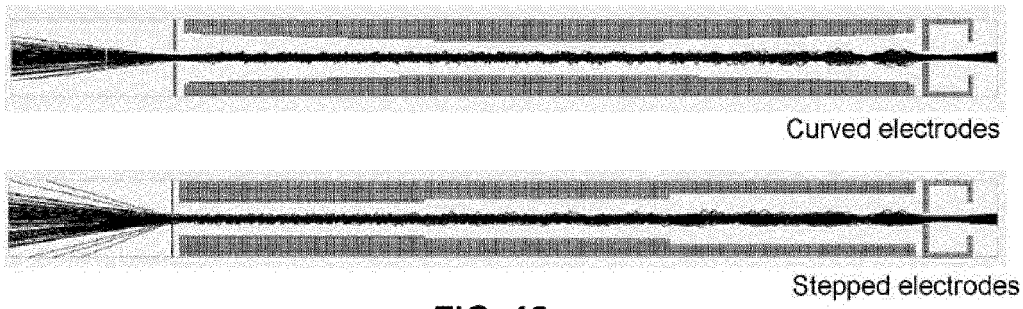
FIG. 18 compares simulated ion trajectories in a curved multipole and a stepped multipole.

An alternative embodiment for addressing the effect of the pseudo-potential barriers resulting from the quadrupole being stepped towards its downstream end is shown in FIG. 13. In this embodiment, the stepped portions are configured at and about the middle of the rods. In this way, the arrangement can provide a high acceptance at the entrance end, operation at a relatively high frequency to pass lower m/z value ions, and a reduced diameter region for ejecting lower m/z ions and for removing background interfering species. However, in addition to these advantages, providing an increased diameter region downstream of the narrowed region provides for improved transmission of ions downstream, out of the collision cell. One contribution to this effect may be from the ions being accelerated by a gradient in the effective potential at the downstream end. This may provide a (very slight) acceleration for ions which are off-axis (the effective gradient is zero along the rotational symmetry axis, and increases towards the rods). However, calculations show that this acceleration effect is very small, if not actually negligible. The reasons for the positive effect of this shape are not fully understood. It is possibly due to a reduction of RF-heating, allowing the ion trajectories to remain straighter when they pass through the downstream opening, giving lower ion losses downstream of the collision cell. This effect is shown in FIG. 18, which is discussed below.

Figure 22:
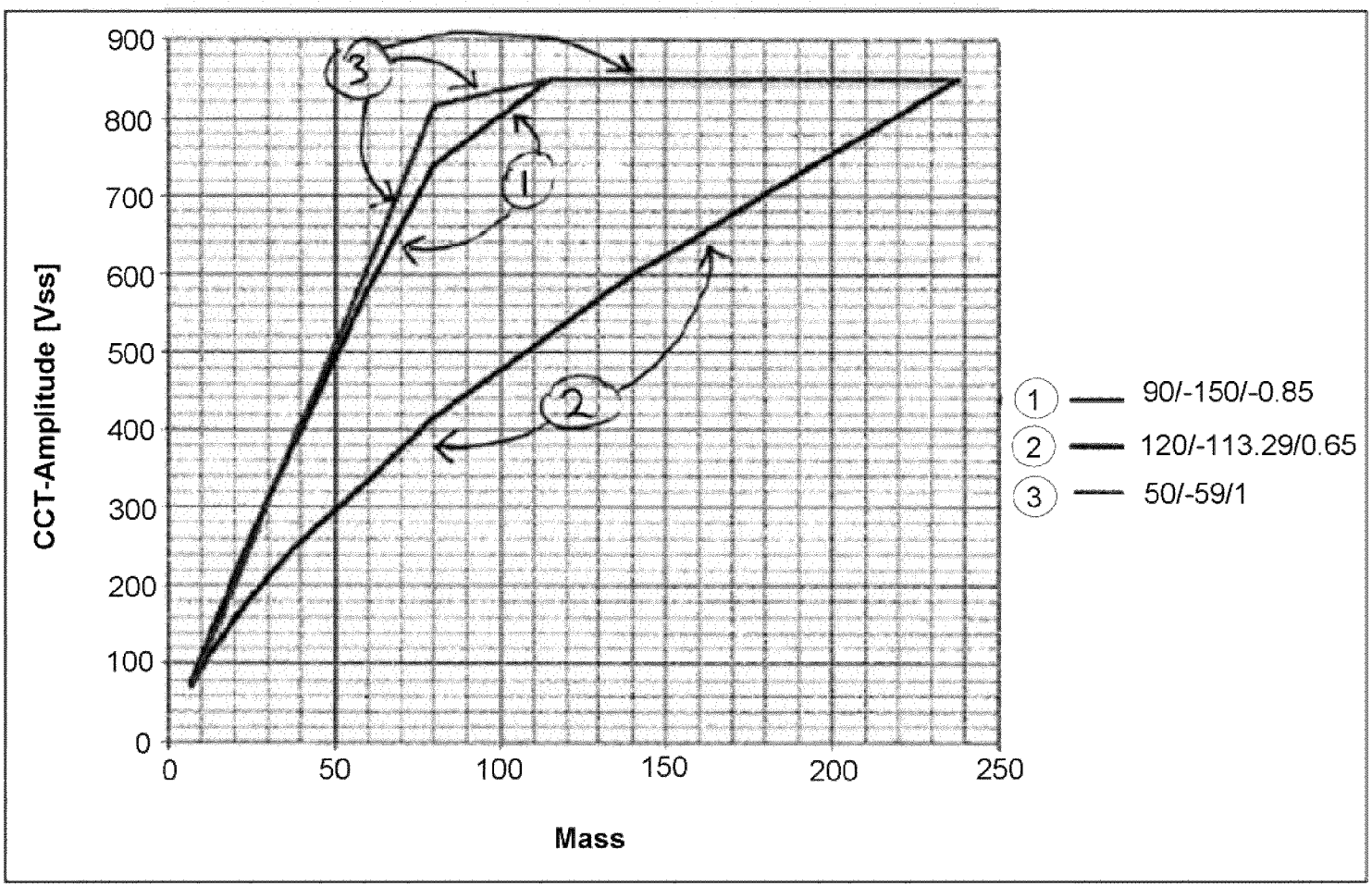
FIG. 22 shows a plot of applied RF amplitude with mass of interest according to one embodiment.

Referring to FIG. 13, there is shown schematically a collision cell 10 with an entrance aperture 20 and an exit aperture 30 and comprising a quadrupole 80. The figure shows a cross section of the cell, so that only two, opposing rods 80*a*, 80*b* are shown. Each rod 80*a*, 80*b* comprises a number of steps extending in a radial direction towards the central axis of the quadrupole. In this case, there are five steps 82-90 symmetrically arranged about the (longitudinal) centre of the quadrupole, with the central step 86 being radially closer to the central axis than its adjacent steps 84, 88, which are themselves radially closer to the central axis than the outermost steps 82, 90 of the quadrupole. To put it another way, the first step 82, at the upstream end of the quadrupole, is configured at a first radial distance $r_1$ from the central axis; the second step 84, adjacent and downstream of the first step 82, is configured at a second radial distance $r_2$ from the central axis; the third step 86, adjacent and downstream of the second step 84, is configured at a radial distance $r_3$ from the central axis; the fourth step 88, adjacent and downstream of the third step 86, is configured at a radial distance $r_4$ from the central axis; and the fifth step 90, adjacent and downstream of the fourth step 88, is configured at a radial distance $r_5$ from the central axis. $r_3$ is the shortest distance, while $r_1$ and $r_5$ are the longest distances. In the embodiment shown in FIG. 13, $r_1=r_5=4.5$ mm; $r_2=r_4=3.75$ mm; and $r_3=3.0$ mm. The overall length of each quadrupole rod in the axial direction is 133 mm. The RF amplitude V is preferably 400 V. As is known, the RF amplitude may be adjusted in dependence on the m/z of interest, as shown by way of example in the plots in FIG. 22. Here, the three different plots represent the variation in RF amplitude V with changing m/z of interest for (1) operation in standard mode, (2) operation in CCT mode, and (3) operation in KED mode. For plots (1) and (2), the voltage amplitude rises quickly with mass, giving a low-mass cut-off relatively close to (but below) the target mass, until a maximum amplitude is reached, generally corresponding to a low-mass cut-off which rejects undesired masses (40Ar, in particular), while allowing transmission of a range of higher masses. Embodiments may therefore be configured to operate in this way: to keep the low-mass cut-off following close to the target mass over a first mass range (e.g., up to approximately m/z=80), then to provide a relatively stable, flat (or only slowly increasing) low-mass cut-off over a second, higher mass range. This can be advantageous in rejecting low-mass interferences and not requiring switching of the RF amplitude when cycling through high masses.

Figure 14:
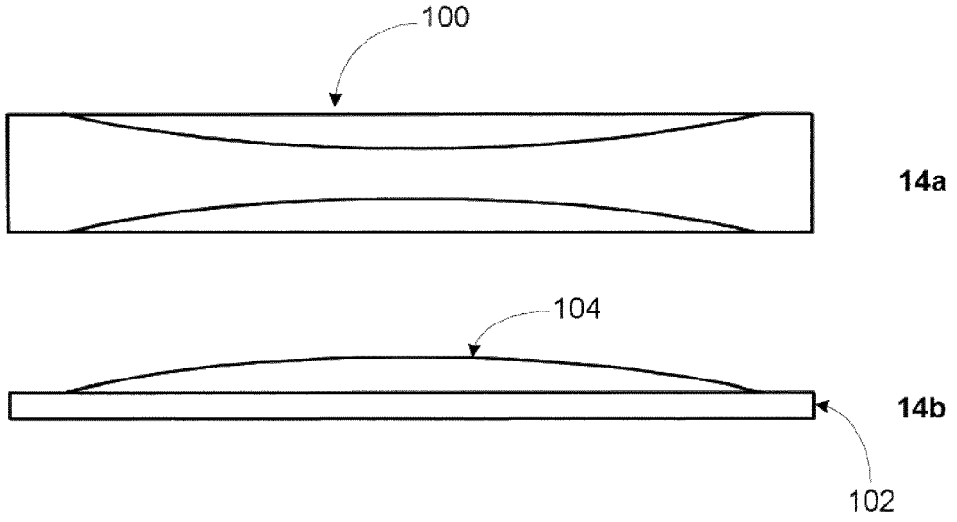
FIGS. 14*a-b* show a curved multipole according to one embodiment.

FIG. 14 shows a further embodiment in which the inner multipole radius narrows from the entrance end of the multipole to its centre and then widens again to its downstream, exit end. In this embodiment, the change in radius is provided by a curved surface of each electrode. Modelling has shown that the stepped portions of the previous embodiment tend to reflect or retard more ions with low energy than multipole electrodes with smoothly curving shapes. FIG. 14*a* shows a plan view of the electrode 100; i.e., as would be seen from the central axis. FIG. 14*b* shows a side view of the electrode 100, from which it can be seen that the electrode 100 comprises a generally rectangular cuboidal portion 102 and a convexly curved portion 104, disposed radially more closely to the central axis of the multipole in use. In the embodiment of FIG. 14, the curved portion 104 also narrows or tapers in the direction of the central axis, to allow the rods to be accommodated about the axis in use. In some embodiments, it may not be necessary to narrow or taper the curved portion in this way. Furthermore, while it can be seen that in the embodiment of FIG. 14 the curved portion 104 does not extend fully to the ends of the generally rectangular cuboidal portion 102, in other embodiments the curved portion may extend along the full length of the electrode 100. Of course, it will be appreciated that the electrodes are typically positioned and held in place by insulating rod holders at each end, so providing a non-curved portion towards each end of the rods may facilitate engagement in such holders.

It should be noted that the curved electrodes 100 are, depending on the method, generally easier to manufacture than the stepped electrodes of the previous embodiment. Typical materials for the electrodes are (stainless) steel and sometimes molybdenum or titanium, but many materials may be used, including carbon or coated glass. Many ways of holding multipoles together are known, including gluing, clamping or bolting to various types of holders, or directly into an enclosure (which is usually present to establish a zone of increased gas pressure or to confine a collision/reaction gas that is different from the surrounding gas, e.g., H, He, $NH_3$, $N_2$, etc.). Manufacturing methods include milling, grinding, erosion, casting, polishing or combinations thereof, and many others. Currently, the preferred method is for the electrodes to be ground to the desired shape, so it is advantageous to have shapes conforming to combinations and sections of various boxes, cones, cylinders, spheres, etc.

In the embodiment shown in FIG. 14, the electrodes 100 are arranged about the central axis such that the upstream end and the downstream end of each rod is at a radial distance of 4.5 mm from the central axis and the centre of each rod (i.e., the closest part of the curved portion 104 to the central axis) is configured at a radial distance of 3.0 mm from the central axis. The radius from the centre of the curved portion varies smoothly towards the outer radius of 4.5 mm. The overall length of the electrode 100 is 133 mm in the preferred embodiment. Of course, it will be understood that, in other embodiments, different values for these parameters may be used and different curvatures of the curved portion may be selected. Selection of these variables may be made and optimised with the help of ion trajectory simulations, as will be readily appreciated.

Figure 15:
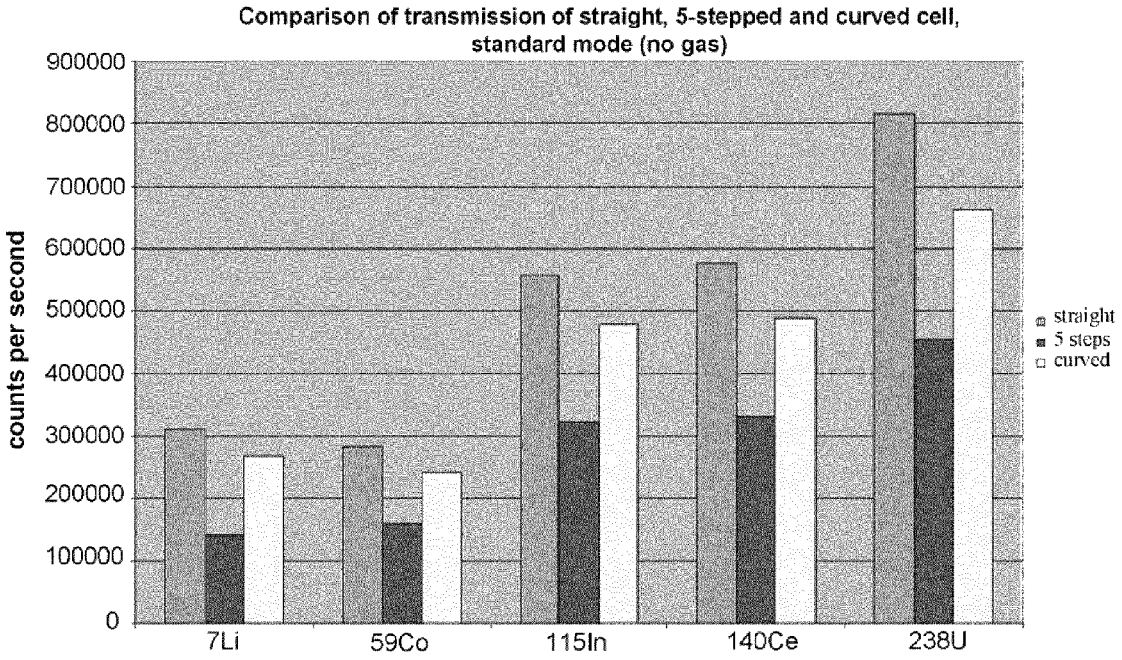
FIG. 15 shows a plot of ion transmission for various multipole configurations in standard mode.
Figure 16:
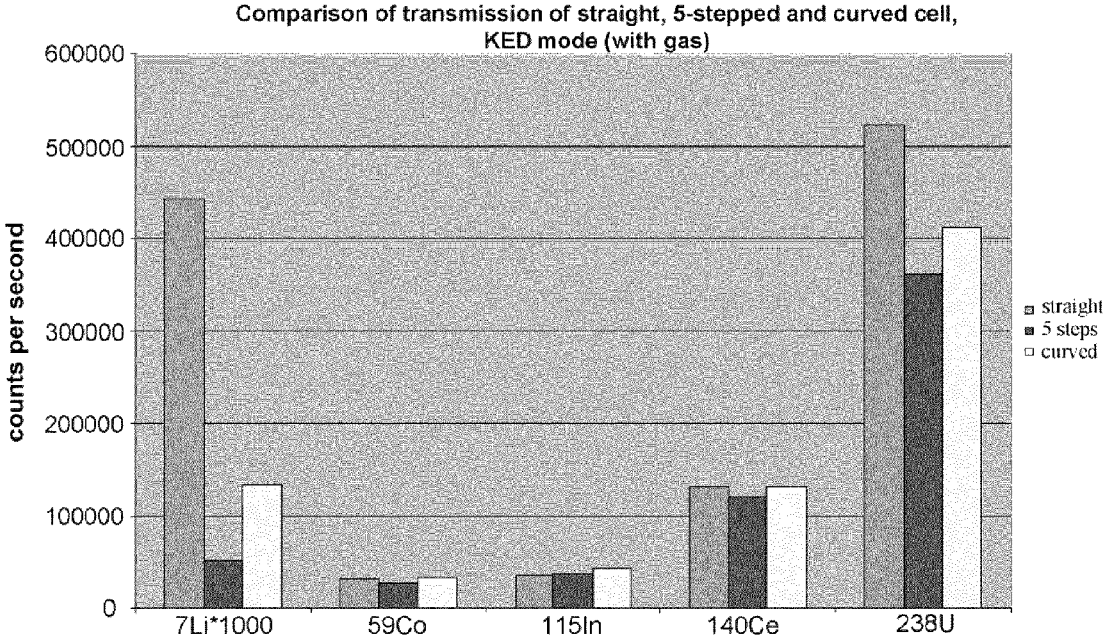
FIG. 16 shows a plot of ion transmission for various multipole configurations in collision mode.

FIGS. 15 and 16 show comparisons of ion transmission through the collision cell using a) a quadrupole with straight rods, b) a quadrupole with five steps (as shown in FIG. 13), and c) a quadrupole with curved electrodes (as shown in FIG. 14). In FIG. 15, the collision cell was operated in standard mode (i.e., with no target gas added), while in FIG. 16, the collision cell was operated with a target gas of helium at a pressure of 2.5 Pa, in KED mode. As can be seen, for all analyte ions, in both standard mode and CCT mode, the ion transmission is better with the curved electrodes compared with the stepped electrodes. Indeed, the transmission for the curved quadrupole is comparable to the transmission for straight rods in all modes (it is noted that the ion transmission for Li in KED mode is, however, somewhat lower), but is also able to provide good background reduction at the same time. Thus, by moving the radially narrowed region of the quadrupole to the centre of the collision cell, it is possible to improve the transmission of Li and the overall transmission as well.

Figure 17:
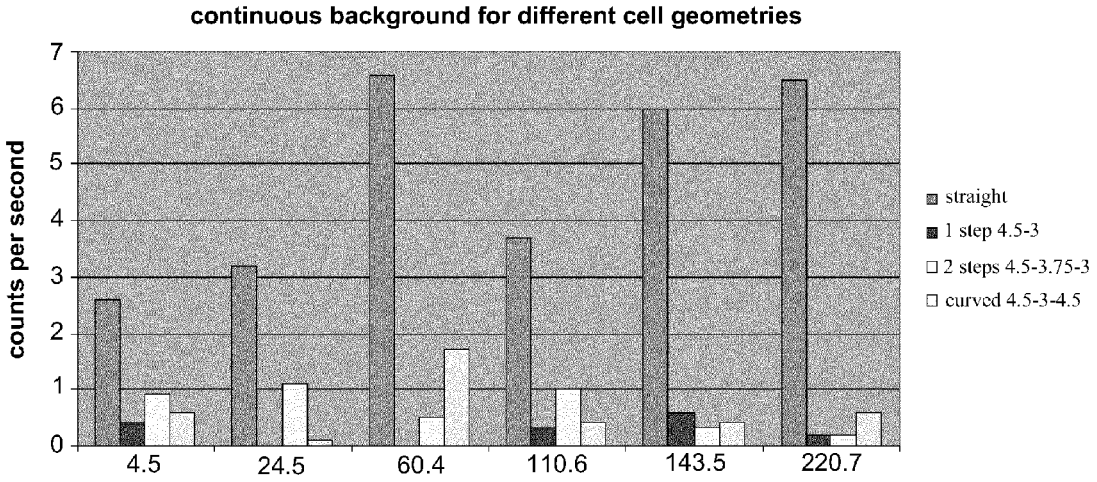
FIG. 17 shows a plot of continuous background count for various multipole configurations.

FIG. 17 shows measurement data and a plot of the continuous background count measured for different m/z values for quadrupoles having a) straight rods set at 4.5 mm from the central axis, b) rods with a single, downstream step, taking the radius from 4.5 mm to 3 mm, c) rods with two, downstream steps, taking the radius from 4.5 mm to 3.75 mm and then to 3 mm, and d) curved rods, with the radius varying from 4.5 mm at the entrance end to 3 mm in the centre, back to 4.5 mm at the exit end. As can be seen, the background count with straight rods operated at the higher frequency of 3 MHz led to background count rates of 6 or more cps. The provision of the steps or curved portion in the electrode rods significantly reduced the background count, generally to around 1 or less per second. Thus it can be seen that applying a higher frequency RF voltage to the electrodes and narrowing the internal radius of the electrodes at and about the centre of the multipole provides improved ion transmission through the multipole, while reducing the background count.

In the table below, measurements of the lithium count at the detector when the collision cell was operated in KED mode are shown for a number of different configurational and operational set-ups. As can be seen, the conventional straight-rod quadrupole with $r_0=4.5$ mm, operated at 1 MHz, shows a zero count rate for lithium (for a Li concentration in solution of 1 ppb). Increasing the frequency to 3 MHz led to a significant increase in the lithium detection, with a count rate of 400 cps. Maintaining this higher frequency, but reducing $r_0$ to 3 mm, led to a drop in the detection of lithium to 50 cps. Providing 1, 2 or 4 steps, as discussed above, led to count rates of 35 cps, 80 cps, and 70 cps, respectively. However, with the embodiment using curved rods, varying from 4.5 mm to 3 mm at the centre, and back to 4.5 mm at the downstream end, the lithium count rate was significantly higher, at 250 cps. Thus it can be seen that, with embodiments of the invention, not only can ion transmission generally be improved and background counts be generally reduced, but specifically lithium transmission can be improved.

| Cell geometry | | | Li [cps] |
|---|---|---|---|
| straight | 4.5 mm | 1 MHz | 0 |
| straight | 4.5 mm | 3 MHz | 400 |
| straight | 3 mm | 3 MHz | 50 |
| 1 step | 4.5-3 mm | 3 MHz | 35 |
| 2 steps | 4.5-3.75-3 mm | 3 MHz | 80 |
| 4 steps | 4.5-3.75-3-3.75-4.5 mm | 3 MHz | 70 |
| curved | 4.5-3-4.5 mm | 3 MHz | 250 |

Li Transmission in KED Mode

FIG. 18 shows ion trajectory simulations a) through a collision cell with a curved quadrupole with the smallest radius in the middle, and b) through a collision cell with a stepped quadrupole with the smallest radius at the downstream, exit end. In both cases, the collision cells were operated in KED mode, with a He collision gas at a pressure of 2.5 Pa, a potential of −60 V at the entrance to the collision cell, a collision cell bias of −21 V, and q=0.3 for the radius at the entrance to the quadrupole. The ions had a m/z of 75 and are shown travelling from right to left in the simulation. As can be seen, the multipole which has the narrower exit radius gives rise to a wider distribution angle of ions travelling downstream. The multipole with the larger radial distance—or, to put it another way, with a reduced q value for a given mass—at its exit end results in a lower angular and energy spread (smaller phase space) of the emerging ion beam. This effect may be due to a reduced effect of fringing fields at the downstream end, and/or reduced RF heating, as discussed above. This is beneficial in facilitating the downstream extraction and/or guiding of the ion beam from the collision cell, towards the mass analyser.

Figure 19:
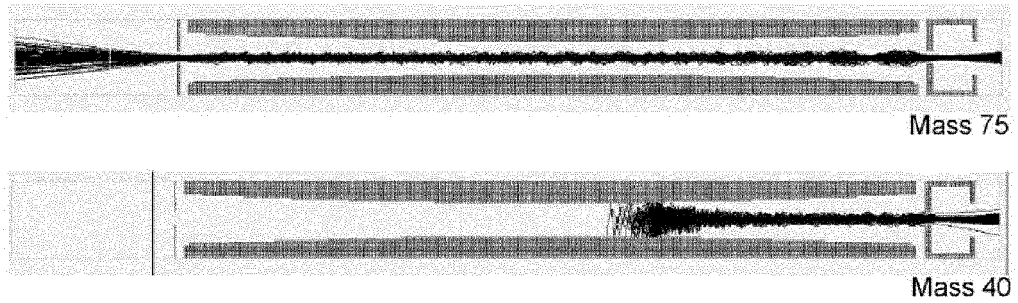
FIG. 19 compares simulated ion trajectories in a curved multipole for different m/z ions.

FIG. 19 shows mass discrimination ion trajectory simulations through a collision cell with a curved quadrupole with the smallest radius in the middle, for a) m/z of 75, and b) m/z of 40. In both cases, the collision cell was operated in standard mode (i.e., with no collision gas supplied), with a potential of −20 V at the entrance to the collision cell, a collision cell bias of −5 V, a particle initial energy $E_0$ of 5 eV, and q=0.3 for the radius at the entrance to the quadrupole. The ions are shown travelling from right to left in the simulation. As can be seen, the ions at m/z=75 are transmitted through the collision cell, while the ions at m/z=40 are discriminated against and rejected within the quadrupole in the collision cell. Thus, embodiments with curved multipole rods may be used to provide the high-pass (low-mass cut-off) characteristics associated with RF-only quadrupoles, to remove undesired, lower mass ions.

Figure 20:
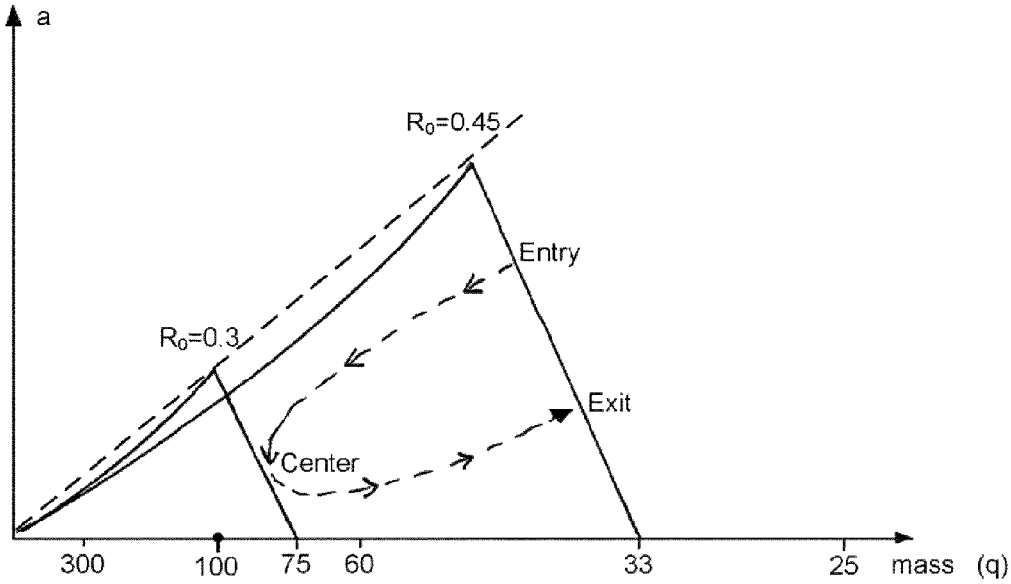
FIG. 20 shows a schematic stability diagram according to one embodiment.

As will be appreciated, embodiments with a curved electrode shape operated in RF-only mode give rise to a variable stability parameter q along the central axis for a given mass. FIG. 20 shows a schematic stability diagram for the curved quadrupole embodiment. Since a=0 for RF-only operation of the quadrupole, the q axis has an exemplary mass scale shown along it. In this example, the RF peak amplitude is constant and configured to transmit m/z=100. As can be seen, a first stability plot is given for $r_0$=4.5 mm and a second, smaller stability plot is given for $r_0$=3.0 mm. In operation, the upper boundary of stability remains constant at q=0.905, but this boundary moves along the mass scale with axial distance through the curved quadrupole. At the entrance to the curved quadrupole, the boundary is given by the first stability plot for $r_0$=4.5 mm. With further penetration into the quadrupole towards its centre, the stability plot shrinks on the mass scale—so the boundary moves—to the second stability plot for $r_0$=3.0 mm. Upon passing the centre of the quadrupole and passing further downstream towards its end, the stability plot expands again on the mass scale—so the boundary again moves—back to the first stability plot for $r_0$=4.5 mm. In this embodiment, ions of m/z below 33 are unstable everywhere. Ions of m/z below 75 are stable at the entrance but become unstable in the centre, so, for example, 40Ar is rejected in the collision cell.

Another way of describing this example is to say that, for a given mass, the q value starts at a relatively low value at the entrance to the quadrupole and grows by a factor of 2.25 towards the centre $[q_2/q_1=(4.5)^2/(3.0)^2]$ and then shrinks again to its initial lower value towards the downstream end.

Figure 21:
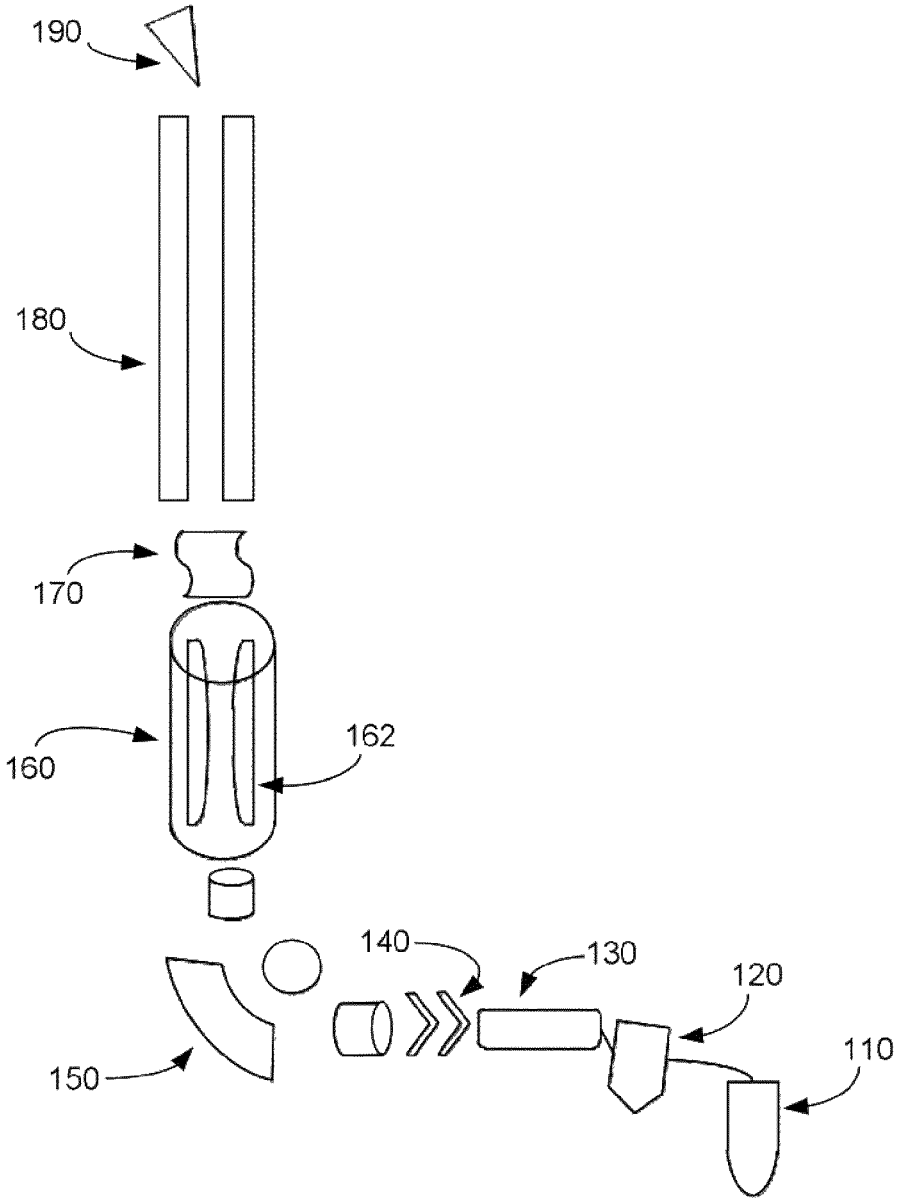
FIG. 21 shows schematically a mass spectrometer according to one embodiment.

FIG. 21 shows schematically an embodiment of the invention in which an ICP mass spectrometer incorporates a collision cell with the curved quadrupole described above. A sample 110, typically a liquid solution or suspension, is supplied by a nebuliser 120 in the form of an aerosol in a carrier gas; generally argon or sometimes helium. The nebulised sample passes into a plasma torch 130, which is arranged to form a plasma from a plasma gas, typically argon. The carrier gas and nebulised sample flow through a central channel of the torch and pass into the plasma, where the temperature is high enough to cause atomisation and then ionisation of the sample. The sample ions in the plasma are sampled and skimmed into a reduced-pressure ambient and subjected to ion-extraction optics 140, to form an ion beam. There are typically further stages of pressure reduction towards the mass analyser, and ion focusing, guiding and/or deflection optics 150 may also be provided to direct the ion beam towards the analyser. A collision/reaction cell 160 is provided upstream of the mass analyser. The collision cell 160 is provided with a curved quadrupole as described in the above embodiments and especially as shown in FIG. 14. Ions transmitted through the collision cell 160 pass into an electrostatic double deflection lens (or dog-leg lens) 170, which is used to deflect ions away from the axis coming from the collision cell and onto the axis of the mass analyser 180. Neutral species and photons are not affected by the field of the double-deflector lens 170, so are generally prevented from entering the mass analyser 180 and causing interference with measurements. The mass analyser 180 is a quadrupole mass filter in this embodiment and its rods are operated with both a DC potential and an RF potential, so that it acts as a bandpass mass filter to selectively pass ions with a desired m/z value on to a detector 190. The detector 190 may be an electron multiplier, a microchannel plate, or a Faraday cup, among others. Of course, the mass spectrometer may alternatively be provided by a magnetic and/or electric sector analyser, a time-of-flight analyser, or an ion trap analyser, FT/MS, among others.

Referring to the collision cell 160 in more detail, there is typically provided a focusing lens (such as a tube lens) in front of the cell. In other embodiments, there may be provided a further mass discrimination means upstream of the collision cell. This may be especially so when the collision cell is used for fragmentation of molecular parent ions into fragment daughter ions, as typically performed in life sciences mass spectrometry, to select a particular parent ion of interest to enter the collision cell.

The collision cell comprises a housing with a gas inlet for supplying one or more target gases to the cell. The housing itself, or insulating electrode holders disposed within the housing, may be used to hold the electrode rods precisely in position. The entrance aperture to the collision cell is provided by a diaphragm with an orifice therethrough and acts as an entrance lens, to which a DC potential is typically applied. The exit aperture to the collision cell is provided by another diaphragm with an orifice therethrough and acts as an exit lens, to which another DC potential is typically applied.

The electrodes are arranged to provide a quadrupole and each of the four rods is configured according to one of the embodiments described herein. One preferred configuration for the quadrupole electrodes is to provide them with flat surfaces in cross-sections normal to the central axis of the quadrupole. Such electrodes are called "flatapoles" and can be useful in reducing noding due to higher order components of the electric field (in an ideal quadrupole, the oscillation of the ions along the axis has a fixed period, somewhat like standing waves on a string. The first "node" of this oscillation is at the entrance opening. Then the deviation of the ions from the central axis increases and decreases periodically with distance from the entrance opening. Unlike with a string, the position of the exit diaphragm does not influence the position of the nodes, but they depend only on the applied RF potential, velocity and mass of the ions, etc. It can be understood that, when a node happens to lie at the exit diaphragm, ion transmission may be very good, and, when an antinode happens to be at the exit opening, transmission may be substantially worse). Such flat surfaces can be used in any of the above embodiments.

One particularly preferred configuration of the electrodes is as above, with each electrode having a curved (convex) shape extending radially towards the central axis and being centred along the axial length of the electrode. In this arrangement, a cross-sectional configuration of the quadrupole normal to the central axis has each electrode at a respective edge of a square centred on the central axis. The electrodes remain at the edges of such a square along the length of the quadrupole, with the size of the square varying along the length and being smallest in the middle of the quadrupole. That is, the rod-to-rod distance at both ends of the quadrupole is larger than the rod-to-rod distance at the centre.

The quadrupole electrodes are provided with a voltage supply (not shown) which is configured to supply RF-only voltages to opposite pairs of electrodes, the RF voltages applied to one pair of electrodes being 180° out of phase with that applied to the other pair. The RF voltage supply is configured to supply a desired RF frequency, which may be in the range from 200 KHz to 20 MHz, preferably in a range from 1, but most preferably 3 to 6 MHz. The most preferred frequency is 4 MHz. For octopoles, the frequency is preferably about twice the value/range as for quadrupoles. For other purposes and MS/MS applications, a preferred range is 0.5 MHz to 5 MHz. The optimum frequency depends on the target mass, the multipole dimensions and the multipole order, as will be appreciated.

The voltage supply may be configured to maintain such frequency constantly. In some embodiments, the multipole electrodes may be configured, for example, having no electrically resistive layer provided thereon, so the RF voltage supply may supply a respective RF voltage to each electrode, wherein for each respective electrode the same amplitude is applied to substantially the whole of the electrode (i.e., there is no voltage drop across an individual electrode). The same, or an additional, voltage supply may be used to provide a bias DC voltage to all of the electrodes, for controlling the axial potential in the collision cell and/or to provide variable DC voltages to the focusing, entrance and/or exit lenses.

Figure 23:
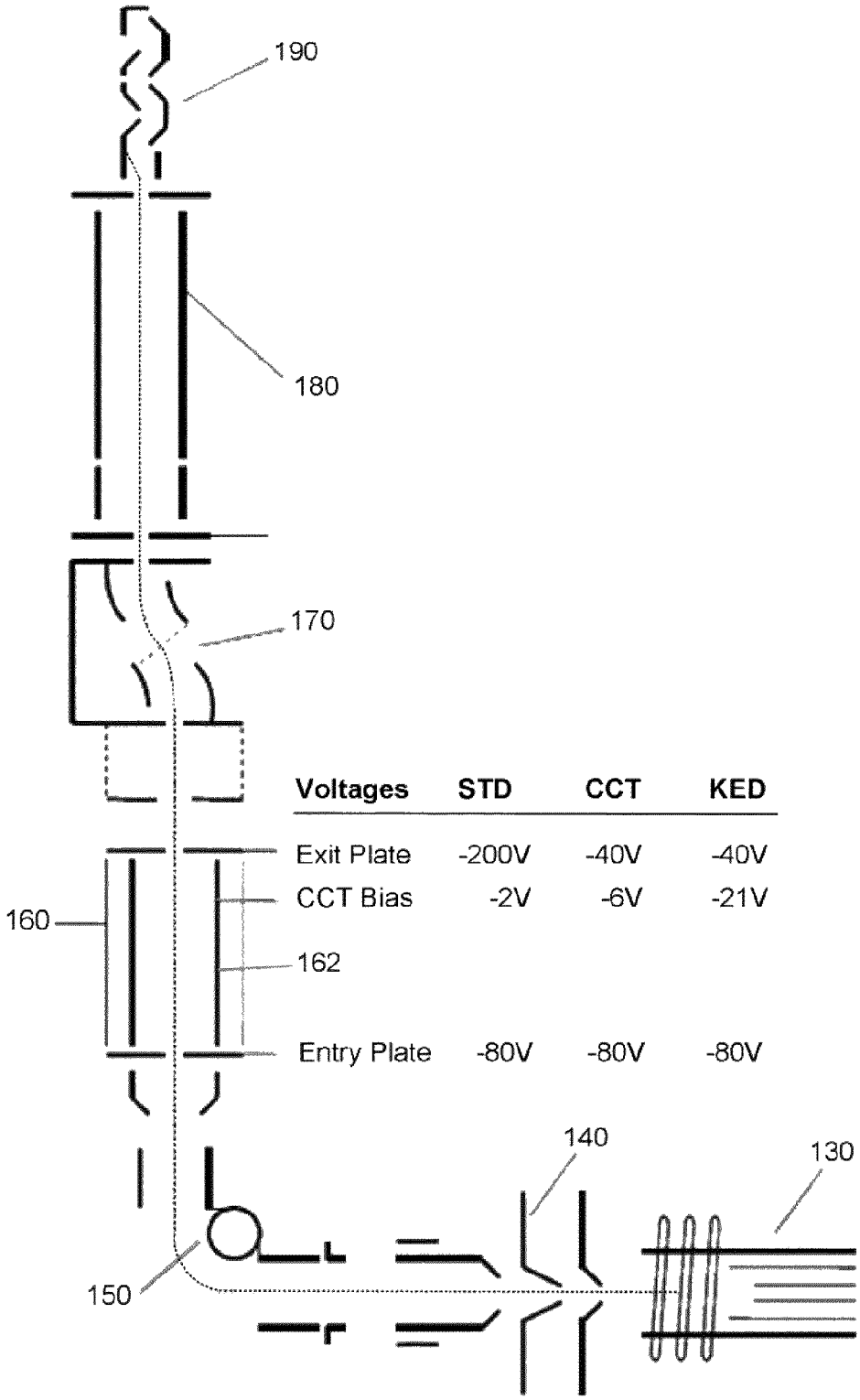
FIG. 23 shows schematically a mass spectrometer according to one embodiment.

FIG. 23 shows schematically a mass spectrometer according to a further embodiment of the invention. Like parts are labelled with the same reference numbers as in FIG. 21. This figure is shown principally to set out the preferred DC bias potentials applied to the various components of the collision cell 160. As can be seen, the bias potentials for the collision cell are provided for a) standard (STD) mode; i.e., with no collision gas, in pass-through or transmission mode; b) collision cell technology (CCT) mode; i.e., with collision/reaction gas added to the collision cell; and c) kinetic energy discrimination (KED) mode; i.e., with a retarding potential barrier applied to prevent low-energy ions from passing on to the mass analyser. It will be appreciated that the values used are typically selected (or automatically tuned) to provide favourable ion lenses within their operating environment.

It will be appreciated that the above embodiments provide an RF-only multipole (i.e., not operating in mass-resolving mode where DC potentials of opposite polarities are applied to different pairs of opposing electrodes; either no DC potential or the same (magnitude and polarity) DC potential may be applied to all electrodes equally, however, since this has a biasing effect, not a mass-resolving effect). The RF-only multipole is provided with a changing q value along its length. The q value changes from a first, relatively low value at the entrance end of the multipole to at least a second value which is relatively higher than the first. In this way, relatively high acceptance and ion transmission may be achieved, while also providing low-mass cut-off for removing undesired, potentially interfering ions and helping to the reduce background count. In a preferred embodiment, there is provided a further change in q value downstream, whereby the q value changes to a third, relatively low value at the exit end of the multipole, preferably the same as the first q value.

The change in q value in the above embodiments is achieved by changing the radial distance of the electrodes from the central axis, in a step-wise or curved manner. In other embodiments, as an alternative or in addition to the change in radius, the change in q value may be effected by changing the frequency of the RF potential applied to different portions of the electrodes in the longitudinal/axial direction—i.e., by providing a relatively high frequency at the upstream end of the multipole and changing this to a relatively lower frequency downstream thereof. If the q value is to be reduced again towards the downstream end, the frequency would be increased again at the downstream end to a third frequency, preferably the same as the first. This may be effected by providing two or three or more electrically segmented electrodes (isolated from one another), with respective connections to a RF voltage supply arranged to provide the same RF amplitude but at different frequencies. Alternatively, the multipole may be subjected to direct drive of the multipole with fast electronic switches; or a square or triangular wave (possibly amplified by a (resonant) coil transformer in the usual way) could be used, directing the ground and "overtone" (i.e. harmonics) frequencies to the different parts of the multipole with a crossover (similar to an audio crossover, just at higher frequencies).

In still other embodiments, as an alternative or in addition to the change in radius and/or frequency, the change in q value may be effected by changing the peak magnitude of the RF potential applied to different portions of the electrodes in the longitudinal/axial direction. At the upstream end of the multipole, a first, relatively low RF magnitude is applied, then a second, relatively higher RF magnitude is applied to a downstream portion. If the q value is to be reduced again towards the downstream end, the RF amplitude would be reduced again at the downstream end to a third RF amplitude, preferably the same as the first. This may be effected by providing two or three or more electrically segmented electrodes (isolated from one another), with respective connections to a RF voltage supply arranged to provide the same RF frequency but at different amplitudes. Alternatively, each electrode may be provided with a resistive coating with two or more connections to a RF voltage supply arranged to provide the same RF frequency but at different amplitudes to the connections. For example, with an arrangement where the q value changes from low to high and back to low again along the length of the multipole, the resistively coated electrodes may be provided with three connections to the RF voltage supply; one at either end and one in the middle. The upstream and downstream ends would be configured with a relatively low RF amplitude, preferably the same, and the central connection would be configured with a relatively higher RF amplitude.

Alternatively still, instead of a multipole as described above, a stacked ring ion guide could be employed, as shown in US-A1-2010/0090104. In this way, relative potential field amplitudes may be achieved by changing the stacking distance, as will be understood.

As discussed above, a DC potential of the same magnitude and polarity may be applied to each of the electrodes of the multipole, so as to create a DC axial field gradient along the multipole in the collision cell, to drive ions through it. This is especially advantageous at higher collision cell pressures. From life sciences mass spectrometry, it is known that the optimum gradient is a function of (e.g., approximately or low multiples of) kT/L (with k being the Boltzmann constant, T being the temperature, and L being the mean free path for the ions).

While the above embodiments have described RF-only modes of operation, in some embodiments, the multipole may be run in a mass-resolving mode. That is, DC potentials of the same magnitude but opposite polarity may be applied to different pairs of opposing electrodes, to provide a mass-discriminating effect in the multipole.

While the above discussion has focused on quadrupoles, embodiments of the invention my employ a hexapole, octopole, or other multipole device in the collision cell, with the principles of the above discussion relating to quadrupoles being correspondingly applied. Quadrupoles are in general preferred, for their low-mass cut-off effect to reject unwanted ions in the collision cell to reduce molecular ion formation and for their better collisional focusing in the CCT mode.

The multipole electrodes of the above embodiments may be flatapoles or may be rods of generally circular, hyperbolic, square, rectangular or other polygonal cross-section; they may be flat or plate-like electrodes; or they may be of various other shapes and configurations, as will be understood from the above discussion.

Embodiments of the invention make use of one or more of the properties of a relatively large multipole internal diameter—giving rise to a high acceptance of ions at the entrance to improve ion transmission into the multipole; a relatively high frequency of the RF voltage applied to the multipole electrodes—giving rise to a lower low-mass cut-off to allow low-m/z analyte ions to pass into the collision cell; a relatively smaller multipole internal diameter downstream of the entrance—giving rise to the rejection of low-m/z ions which may be formed in the collision cell and a reduction in the background count caused by neutrals from a high ion current; and a relatively larger multipole internal diameter downstream of the reduced-diameter region—giving rise to a smaller angular and energy spread of those ions out of the collision cell for improved downstream processing.

Although preferred embodiments have the smallest radial region of the multipole symmetrically disposed at the centre of the multipole, the smallest radial region may be configured off-centre, so that the multipole is not symmetrical. In this way, the acceptance at the entrance and the reduced angular and energy spread at the exit may be optimised by adjustment of the position along the length of the multipole where the reduced radius portion is provided. Indeed, the curved or stepped shape of the reduced radius portion need not itself be symmetrical, but may have some degree of skewness in form.

Furthermore, while the above embodiments have described the electrodes of the multipole as each having the same shape, this need not be so in all embodiments. It may be desirable in some applications to arrange a single opposing pair of electrodes (or more than one respective opposing pair in higher multipoles) to have a respective reduced radius region, while providing the remaining opposing pair (or pairs in higher multipoles, or even individual electrodes in odd-numbered multipoles) with different respective forms. In particular, it may be desirable to provide the electrodes disposed in the X-direction with different shapes from the electrodes disposed in the Y-direction.

Other variations, modifications and embodiments will be apparent to the skilled person and are intended to form part of the invention.

The invention claimed is:

1. A method of operating a multipole in a collision cell, the multipole comprising a first portion, a second portion and an intermediate portion therebetween, the method comprising the step of operating the first and second portions at respective first and second q values lower than a third q value at the intermediate portion; wherein the step of operating the first and second portions at respective first and second q values lower than the third q value at the intermediate portion comprises at least one of: positioning the intermediate portion radially closer to a central axis of the multipole than the first portion and the second portion; or applying a different RF voltage amplitude to the intermediate portion relative to the RF voltage amplitude applied to the first portion and the second portion; or applying a different RF voltage frequency to the intermediate portion relative to the RF voltage frequency applied to the first portion and the second portion.

2. The method of claim 1, further comprising receiving ions into the first portion of the multipole, transmitting at least some of the received ions through the intermediate portion with a relatively smaller inner multipole radius, and passing at least some of the transmitted ions out of the second portion.

3. The method of claim 1, further comprising applying a respective RF voltage to each electrode of the multipole at a frequency in the range from 3 MHz to 6 MHz.

4. The method of claim 1, further comprising providing a supply of a target gas to the collision cell to a pressure in the range from 0.01 Pa to 1000 Pa.

5. The method of claim 1, further comprising the step of applying an axial DC field gradient to the multipole.

6. The method of claim 1, further comprising the step of tracking a low-mass cut-off of the multipole close to a changing target mass over a first mass range, then maintaining the low-mass cut-off relatively stable over a second, higher mass range.

7. The method of claim 1, wherein the multipole comprises a plurality of multipole electrodes, and wherein at least some of the multipole electrodes comprise one or more respective pairs of radially opposing electrodes in the multipole.

8. The method of claim 1, wherein the multipole comprises a plurality of multipole electrodes arranged around the central axis, and wherein the at least some of the electrodes are stepped in a direction of the central axis.

9. The method of claim 8, wherein a respective transition to or from the or each step is sloped.

10. The method of claim 1, wherein the multipole comprises a plurality of electrodes arranged around the central axis, and wherein the at least some of the electrodes are curved in a direction of the central axis.

11. The method of claim 1, wherein the multipole comprises a plurality of electrodes arranged around the central axis, and wherein a cross-section normal to the central axis of a surface of each electrode radially closest to the central axis is substantially flat.

12. The method of claim 1, wherein the multipole is a quadrupole.

* * * * *

UNITED STATES PATENT AND TRADEMARK OFFICE

CERTIFICATE OF CORRECTION

PATENT NO. : 9,099,290 B2
APPLICATION NO. : 14/367845
DATED : August 4, 2015
INVENTOR(S) : Jung et al.

It is certified that error appears in the above-identified patent and that said Letters Patent is hereby corrected as shown below:

On the title page item (30), (Foreign Application Priority Data)
Delete "112073.8" and
insert -- 1122073.8 --, therefor.

Signed and Sealed this
Fifteenth Day of March, 2016

Michelle K. Lee

Michelle K. Lee
*Director of the United States Patent and Trademark Office*